United States Patent [19]

Boring, Jr.

[11] Patent Number: 4,642,820

[45] Date of Patent: Feb. 17, 1987

[54] BIDET

[76] Inventor: Glenn E. Boring, Jr., 8020 24th Ave. North, St. Petersburg, Fla. 33710

[21] Appl. No.: 777,932

[22] Filed: Sep. 19, 1985

Related U.S. Application Data

[63] Continuation-in-part of Ser. No. 625,605, Jun. 28, 1984, abandoned.

[51] Int. Cl.[4] ..... A47K 3/20

[52] U.S. Cl. ..... 4/420.4; 4/448; 137/616.7

[58] Field of Search ..... 4/420.1, 420.4, 420.5, 4/447, 448, 444, 443; 74/67, 68, 96; 137/616.7; 239/569

[56] References Cited

U.S. PATENT DOCUMENTS

| | | | |
|---|---|---|---|
| 1,521,892 | 1/1925 | Koppin | 4/420.4 |
| 2,278,055 | 3/1942 | Bigio | 4/7 |
| 2,852,782 | 9/1958 | Sundberg | 4/7 |
| 3,605,124 | 9/1971 | Marcaro et al. | 4/420.2 |
| 4,062,072 | 12/1977 | Roberts | 4/420.4 |
| 4,069,519 | 1/1978 | Alexander | 4/447 |
| 4,083,383 | 4/1978 | Antoniello | 137/616.7 |
| 4,092,744 | 6/1978 | Butoi | 4/420.4 |
| 4,304,016 | 12/1981 | Omuga et al. | 4/420.2 |
| 4,334,329 | 6/1982 | Miyanaga | 4/443 |
| 4,383,339 | 5/1983 | Miller | 4/420.4 |

*Primary Examiner*—Stephen Marcus
*Assistant Examiner*—Linda J. Sholl
*Attorney, Agent, or Firm*—Richard M. Saccocio; Jack E. Dominik

[57] ABSTRACT

Personal hygiene apparatus is disclosed comprising a base having control apparatus and nozzle apparatus attached thereto. The inventive apparatus fits on the back upper surface of a toilet bowl and under the toilet seat. The control apparatus is used to move a flow nozzle from a nonuse position under the toilet's rim, to a center position. Further operation of the control apparatus opens a valve which allows a fluid to flow through and out of the nozzle apparatus. Further operation of the control apparatus shuts off the fluid flow and then returns the nozzle to its original nonuse position.

6 Claims, 8 Drawing Figures

BIDET

REFERENCE TO RELATED APPLICATION

This patent application is a continuation-in-part of Ser. No. 625,605, filed June 28, 1984, now abandoned, entitled "Bidet," invented by M. Dan Manning and Glenn E. Boring, Jr.

BACKGROUND OF THE INVENTION

1. Field of the Invention

This invention relates in general to conventional flush toilets or water closets having associated therewith apparatus for personal hygiene, and in particular is directed to bidet apparatus adapted to be attached to the toilet structure and by means of which device a spray of a fluid may be controllably directed by the user against a particular portion of the user's body.

2. Description of the Prior Art

Heretofore, a number of devices have been disclosed whereby the functional operational aspects of a bidet are achievable by such apparatus which are variously attached to the structure of the toilet and are controllable by the user. The method of operation of such prior art devices are, of course, quite varied. Many of the devices operate to serve the dual purpose of cleaning a person's posterior area and cleaning the person's genital area. Such devices also include means for adjusting the spray and adjusting the temperature of the solution being sprayed. Even further devices provide for the incorporation of cleaning solutions and deodorizing solutions within the fluid being sprayed.

Notwithstanding the relatively large number of previously issued patents directed toward the subject matter as stated herein, the lack of widespread use of such devices is apparent. While the reasons for such lack of widespread use may not be stated with absolute certainty, but in view of the numerous attempts to achieve the end result of such prior art devices, it is highly probable that the prior art devices are lacking in one way or another. For example, many of the prior art devices are quite bulky and therefore present a relatively unsightly appearance. Other devices are quite complicated and do not readily lend themselves to ease of use. Still other devices tend to interfere with the normal function of the toilet. Still other devices are deficient in that the user is unable to readily ascertain just where the fluid to be sprayed will be directed. In these latter devices, it is readily seen that the benefits of the device are diminished from the initial misdirected operation of the fluid jet. Other prior art devices tend to be unreliable in their design and method of operation, and accordingly, do not function as desired.

Accordingly, main objectives of the present invention comprise: providing apparatus for personal hygiene which may be easily attached to a common toilet in such a manner that the apparatus and its method of attachment is aesthetically pleasing to all persons who may see or use the apparatus; providing apparatus whereby the user may readily discern or ascertain the location of the tip of the fluid spray apparatus so that it is immediately directed to a predetermined and desired part of the user's body; providing apparatus which is simple in construction such that both convenience of use result and a high degree of reliability is achieved; and, providing apparatus which in and of itself allows for a high degree of hygiene.

There are, of course, other objects of the present invention which although not specifically stated will be apparent to those ordinarily skilled in the art to which this invention pertains, and which other objects are intended to be included within the presently disclosed invention.

SUMMARY OF THE INVENTION

The present invention accomplishes the above-stated objectives by providing apparatus for personal hygiene comprising an attachment to be fitted to a conventional toilet bowl and provides for the bathing and cleansing of a person's posterior and/or genital area.

The inventive apparatus comprises a base which is designed to be attached to the toilet bowl and to which is mounted the operative parts of the sanitary apparatus. In general, the base comprises a flat plate having means thereon allowing its attachment to the toilet bowl by utilizing the existing bolts which attach a conventional toilet seat to the bowl.

A combination fluid control valve and spray nozzle position control apparatus is attached to one end of the base. Spray nozzle apparatus is attached to the base adjacent to the other end of the base. A fluid flow line connects the combination control apparatus to the spray nozzle apparatus. Similarly, a nozzle position control device is connected from the combination apparatus to the nozzle. Both the interconnecting fluid flow line and the interconnecting control apparatus are provided integral with the base and accordingly are not observable by means of the naked eye; do not interfere with the normal function of the toilet; and, do not interfere with the toilet seat attachment.

In operation, the user first positions the location of the nozzle by means of appropriate rotation of control apparatus connected to the combination apparatus, further rotation of the control apparatus then initiates the flow of the fluid to be dispensed in an amount consistent with the force of the spray which is desired to be used. Upon completion of the use of the sanitary apparatus, the user then simply again rotates the single control level or knob, whereby the fluid is shut off and the nozzle is rotated to a nonuse position under the base and away from the toilet bowl proper. The toilet may then be used in an ordinary manner without interference from the inventive apparatus.

Various other objects, advantages and features of the invention will become apparent to those skilled in the art from the following discussion taken in conjunction with the following drawings, in which:

DETAILED DESCRIPTION OF THE PREFERRED EMBODIMENTS

Figures 1, 2:
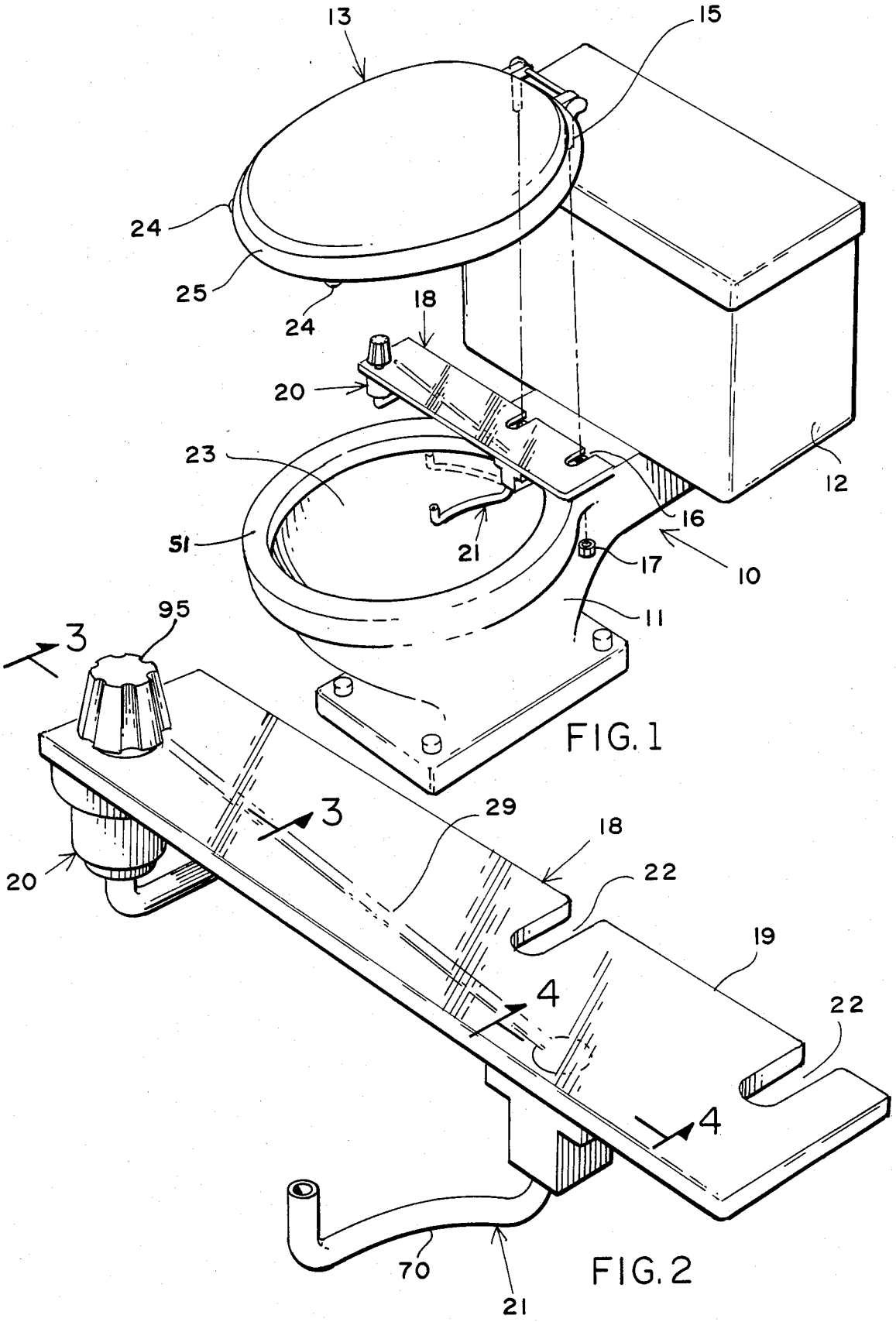
FIG. 1 is a perspective view of conventional toilet unit with the present personal hygiene apparatus positioned thereon, with the toilet seat shown in an exploded view in relation to the toilet bowl.
FIG. 2 is an enlarged perspective view of the present personal hygiene apparatus illustrating the relative positions of the combination control apparatus and the rotatable spray nozzle with respect to the mounting base.

Reference is now made to the various figures of the drawings wherein like characteristics are designated by the same reference numerals among the various figures.

As may be seen in FIG. 1, a conventional water closet 10 comprises a toilet bowl 11, a water tank 12, and a toilet seat 13. Toilet seat 13 is attached to toilet bowl 11 by means of conventional toilet seat fasteners which may, for example, comprise ordinary bolts 15 which are permanently fixed to the toilet seat and pass through openings 16 within and through the toilet bowl 11 and which are secured thereto by nuts 17. Although water closet 10 is shown in isolation, such apparatus will, of course, be located within an ordinary bathroom. And, although not shown, appropriate water supply lines and water drainage lines are conventionally connected to water closet 10.

Referring also now to FIG. 2, the inventive apparatus is generally designated by the numeral 18. The inventive apparatus 18 comprises a base comprising a mounting plate 19, combination fluid control and nozzle position control apparatus 20, and nozzle apparatus 21.

The inventive apparatus 18 is intended to be simply and conveniently attached to the water closet 10. In this regard, a pair of slots 22 are provided in mounting plate 19 having a width dimension which is slightly larger than the outer diameter of bolts 15. Furthermore, the space between slots 22 is consistent with the between center spacing of bolts 15. In the manner thus provided, the mounting plate 19 of the inventive apparatus 18 may be mounted to the water closet 10 between a lower surface of the toilet seat 13 and an upper surface at the back portion of the toilet bowl 11. Such mounting may be effectuated by loosening nut 17, slightly lifting toilet seat 13 and then fitting the mounting plate 19 of the inventive apparatus 18 within the space thereby created and such that bolts 15 are engaged within slots 22. Nuts 17 may thereafter be retightened thereby fixedly securing the inventive apparatus 18 to the back side of the horizontal rim of the toilet bowl 11. During the period of installation, the clearance space between slots 22 and bolts 15 allow for adjustment of the position of the inventive apparatus 18 in order to properly position the same relative to the water closet 10. When properly installed, nozzle apparatus 21 will be located within the interior 23 of toilet bowl 11 and back against the rear vertical portion of the rim 51 of toilet bowl 11. Also, the combination control apparatus 20 will be located on the outside of toilet bowl 11 and also the rear thereof. It is to be noted, that in the example shown in the drawings, the combination control apparatus 20 is located on the right side of the water closet 10 relative to the user. Although not shown, it is to be understood that the location of the combination control apparatus 20 may be similarly located on the left side of the water closet. Such location is not critical to the operation of the invention.

The thickness of mounting plate 19 may be of the order of one-half an inch, plus or minus one-quarter of an inch. A thickness within this range has been shown to be most satisfactory as regards overall operation of the apparatus. The plate thickness may or may not cause slight elevation of the back portion of toilet seat 13. Assuming that there is a slight elevation, such slight elevation will, of course, result in a slight tilting of the forward portion of the toilet seat 13, however, any slight tilting has been demonstrated to be a relatively inconsequential inconvenience. If, however, it is desired to reposition the toilet seat 13 such that it is again horizontal, support pads 24 having a thickness which is necessary to compensate for the tilting, may be attached to the existing support pads on the underside of toilet seat 13. Alternatively, the existing mounting pads may be replaced by new mounting pads having a combined thickness of the original mounting pads plus the compensating thickness.

Figure 3:
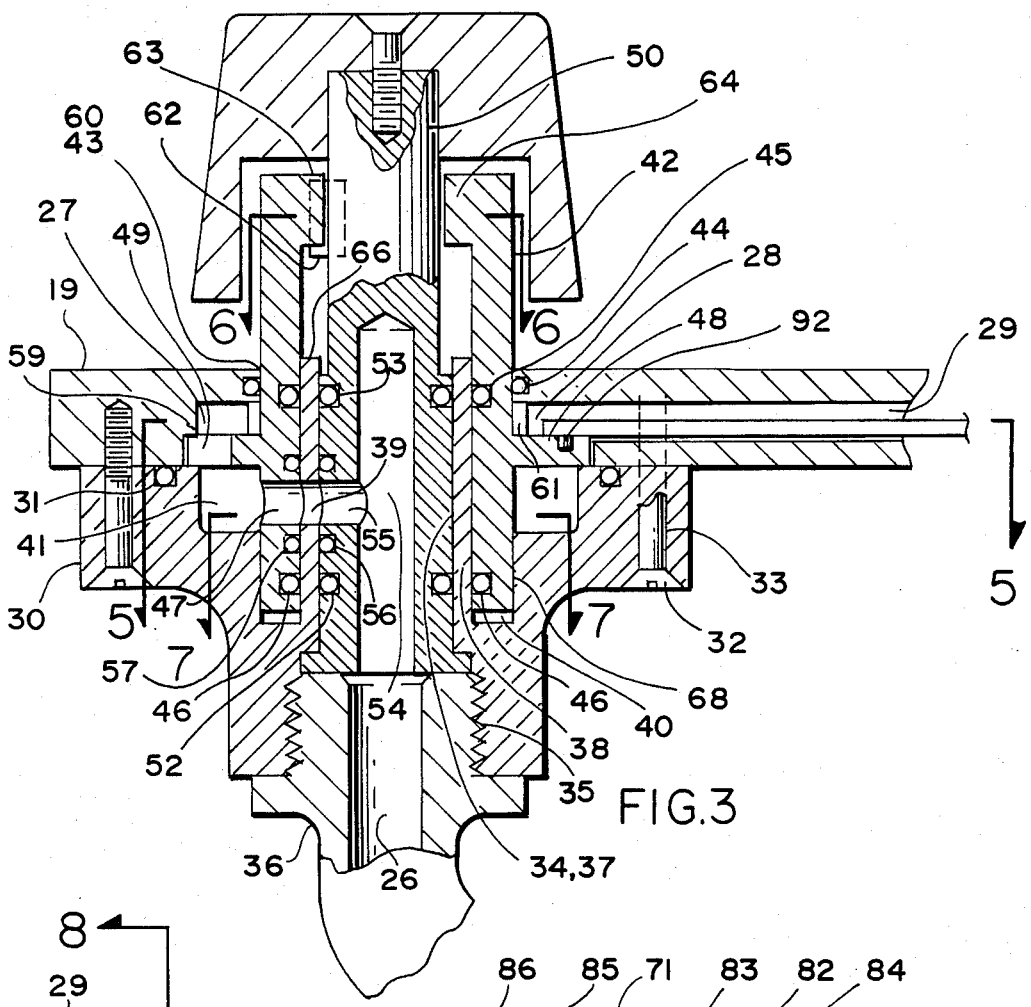
FIG. 3 is a cross-sectional view of the combination control apparatus taken along the line 3—3 of FIG. 2.
Figure 4:
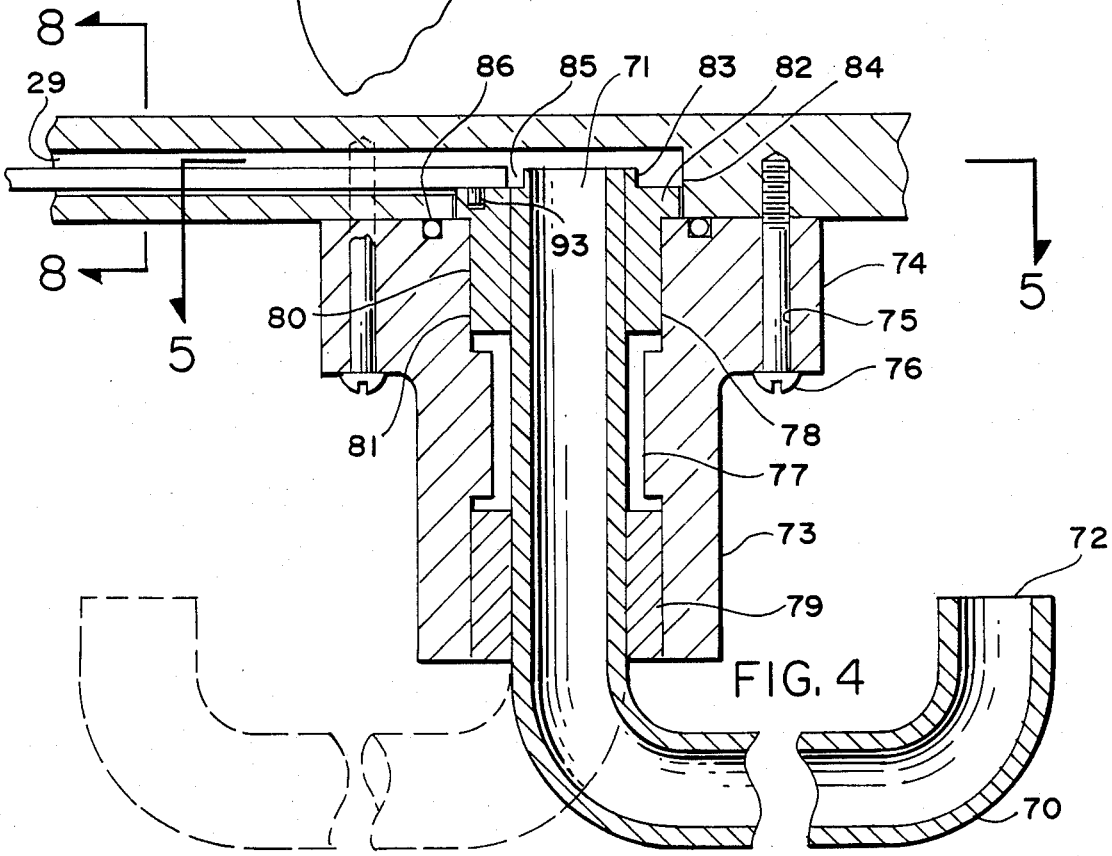
FIG. 4 is a cross-sectional view of the nozzle apparatus taken along the line 4—4 of FIG. 2.
Figure 5:
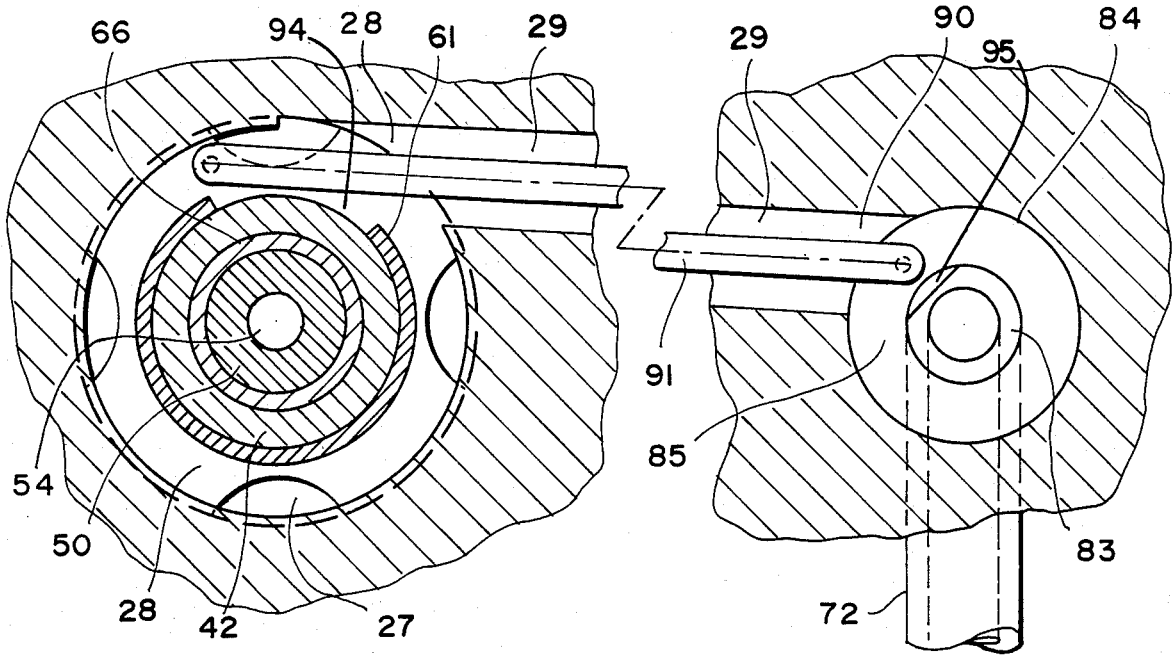
FIG. 5 is a cross-sectional view of the combination apparatus, the fluid passage and integral control lever and fluid passage conduit, and the rotatable nozzle apparatus of FIGS. 3 and 4, taken along the line 5—5 thereof.

Reference is now made to FIGS. 3, 4, and 5 of the drawings which together illustrate further details of the inventive apparatus 18 when taken in accordance with the following description.

The combination control apparatus 20 comprises means to control the operation of the fluid to be dispensed and to control the motion of the nozzle which dispenses the fluid. In one mode of control, combination control apparatus 20 controls the on-off operation of the fluid to be dispensed by the inventive apparatus 18. In other words, this mode of operation comprises a fluid control valve which either opens or closes a fluid communication passageway between inlet port 26 and outlet port 27. Inlet port 26 may be appropriately attached to a source of fluid (not shown) to be dispensed by the inventive apparatus 18. Outlet port 27 comprises an opening within mounting plate 19 which is in flow communication with the inlet 28 of interconnecting conduit 29. Interconnecting conduit 29 comprises a flow connection between the combination control apparatus 20 and the nozzle apparatus 21.

Referring more particularly to FIG. 3, a housing 30 is sealing connected by seal 31 to mounting plate 19 by means of fasteners 32. Housing 30 may comprise a substantially cylindrical (or any other appropriate shape) member having openings 33 therethrough for fasteners 32 by which housing 30 may be attached to plate 19. A through opening 34 is provided at the approximate center of housing 30. A first portion 35 of opening 34 may be threaded in order to permit the connection thereto of an appropriate source of fluid (not shown) to the inventive apparatus 18. A second portion 37 of opening 34 comprises the inner diameter of a stationary cylindrical member 38 which extends up from the threaded opening 35 to a location above the top of housing 30 by an amount approximately equal to the thickness of plate 19. An opening 39 is provided in the wall of cylindrical member 38. Cylindrical member 38 may be made integral as shown with housing 30 or may comprise a separate piece appropriately attached and sealed to housing 30. A first annular space 40 within housing 30 and outside cylindrical member 38 is provided at the base of cylindrical member 38. A second annular space 41 is provided above annular space 40.

A nozzle cam 42 fits within the first annular space 40 and around cylindrical member 38 and extends therefrom and through hole 43 in plate 19 in the manner shown in FIG. 3 of the drawings. Seal 44 which may comprise an "O" ring seal, seals the clearance space between the extending portion of nozzle cam 42 and hole 43 through plate 19. Nozzle cam 42 is also sealingly connected within housing 30 by means of appropriate seals 45 and 46, such as "O" rings, which are axially spaced between the inner surface of nozzle cam 42 and the outer surface of cylindrical member 38. An opening 47 in nozzle cam 42, which may comprise a cylindrical opening through the wall of nozzle cam 42, provides flow communication between opening 39 in cylindrical member 38 and the cylindrical plenum comprising annular space 41. Nozzle cam 42 is rotatable relative to cylindrical member 38 so as to also prevent such flow communication by misaligning holes 39 and 47.

Flange 48 which extends radially out from the generally cylindrical shape of nozzle cam 42, serves to axially align or position nozzle cam 42 within housing 30. Such axial positioning is accomplished by the lower surface of flange 48 fitting against the top surface of housing 30. One or more cutouts 49 through the thickness of flange 48 are provided for purposes of fluid flow communication from plenum 41 to outlet port 27.

Valve stem 50 fits within the inner diameter 37 of cylindrical member 38; is mounted for rotational movement, and is sealingly connected thereto by means of seals such as "O" ring seals 52 and 53. Valve stem 50 includes blind hole 54 provided in the bottom part of the valve stem 50. An opening 55 through the wall of valve stem 50 is provided which axially coincides with the opening 47 in nozzle cam 42 and opening 39 in cylindrical member 38. Rotation of valve stem 50 permits, as explained below, alignment of opening 55 with opening 39 in cylinder 38 and opening 47 in nozzle cam 42. When openings 55, 39, and 47 are so aligned, fluid which enters through fitting 36 is permitted to flow from blind hole 54 through aligned openings 55, 39, and 47 and then into the plenum 41 formed by cylindrical annulus within housing 30, and then through cutouts 49 in flange 48 and into outlet port 27. Thus, in order to effectuate flow communication between the inlet 26 of fitting 36, and outlet port 27 of the combination control apparatus 20, it is required that all three openings 55, 39, and 47 be aligned. On the other hand, in order to interrupt such flow communication or to stop the flow of the fluid through the inventive apparatus 18, it is only required to have one of the three openings 55, 39, or 47 not aligned with either of the other two openings. Seals 56 and 57 seal around and between openings 55, 39, and 47.

The upper portions of nozzle cam valve stem 50 and cylindrical member 38 pass through opening 43 of plate 19. Opening 43 comprises a lower portion 59 and an upper portion 60. Lower portion 59 comprises a counterbored cylindrical opening having a diameter slightly larger than the outer diameter of flange 48 on nozzle cam 42. In this manner, flange 48 is permitted to fit within counterbored opening 59 so that nozzle cam 42 is captured between housing 30 and plate 19. It is to be noted, however, that the thickness of flange 48 for flow purposes is less than the depth of counterbore 59 within plate 19. A spacer member 61 which may comprise a circular ring having an outer diameter substantially less than the inner diameter of cylindrical opening 59, is utilized to fill the remaining axial space between flange 48 and counterbore 59. Since the outer diameter of spacer member 61 is smaller than inner diameter of counterbore 59, spacer member 61 does not interfere with the flow communication into outlet port 27. Outlet port 27 may, therefore, be defined as the annular space between the outer diameter of spacer member 61 and the inner diameter of cylindrical opening 59. It will be remembered that outlet port 27 is in flow communication with plenum 41 by means of the one or more cutouts 49 in flange 48.

Figure 6:
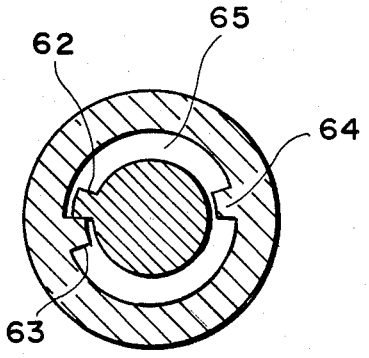
FIG. 6 is a cross-sectional view of the combination control apparatus taken along the line 6—6 of FIG. 3.
Figure 7:
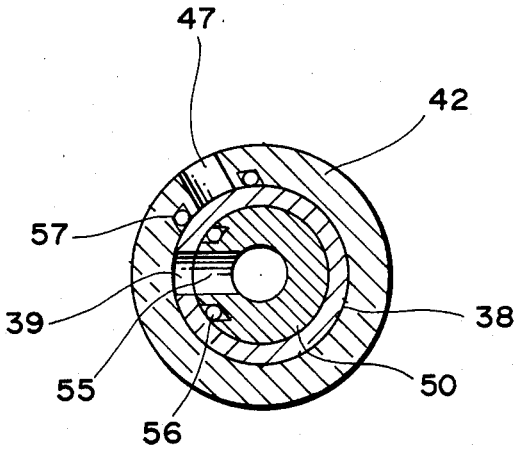
FIG. 7 is a schematic across sectional view of the valving arrangement of the invention apparatus taken along the line 7—7 of FIG. 3 with item 47 rotated for purposes of illustration; and, FIG. 8 is a cross-sectional view of the communicating flow channel between the control apparatus and the nozzle apparatus taken along the line 8—8 of FIG. 4.
Figure 8:
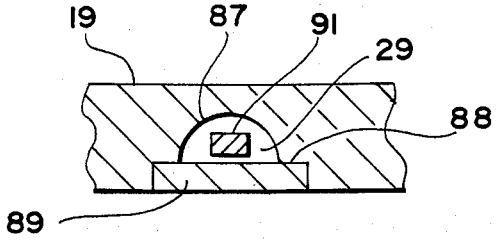

Relative rotational motion between valve stem 50, nozzle cam 42 and cylindrical member 38 is, of course, essential to the ability to align and to disrupt the alignment between openings 55, 39, and 47 in order to effectuate the valving mode of operation of the inventive apparatus 18. In the embodiment shown in the drawings, particularly FIG. 6, such relative motion is achieved by the interaction between driver lug 62 on the outer diameter of valve stem 50 and driven lugs 63 and 64 on the inner diameter of nozzle cam 42. Driven lugs 63 and 64 are spaced apart by approximately 180°. When lugs 62, 63, and 64 are arranged as shown in FIG. 6, flow holes 55, 39, and 47 are oriented relative to each other as shown schematically in FIG. 7, and flow through the inventive apparatus 18 is shut off.

The cylindrical clearance space 65 between, for example, driver lug 62 and driven lug 64, allows rotation of valve stem 50 independent of nozzle cam 42. On the other hand, counterclockwise rotation of valve stem 50 by 45° causes 45° counterclockwise rotation of nozzle cam 42. This rotation causes alignment of holes 47 and 39. Then, 45° clockwise rotation of valve stem causes hole 55 to also become aligned with holes 47 and 39. In this mode, flow is commenced. As further explained below, the initial position of valve stem 50 and nozzle cam 42 shown in FIG. 6 corresponds to the nozzle apparatus 21 being in the nonuse position and the fluid flow is off. The second position described above (when the valve stem is rotated 45° counterclockwise) corresponds to the nozzle apparatus being moved to the use position and the fluid flow is off. The third position (when the valve stem is rotated 45° clockwise) corresponds to the nozzle apparatus 21 being in the use position and the fluid flow is on.

Nozzle apparatus 21 is seen in axial cross section in FIG. 4 and in horizontal cross section in FIG. 5 of the drawings. Nozzle apparatus comprises a generally "U"-shaped tube 70 having an inlet 71 and an outlet end 72. Inlet end 71 is in flow communication with outlet port 27 of the combination control apparatus 20 by means of flow conduit 29. Outlet end 72 serves to direct the flow of the hygienic fluid passing through the inventive apparatus 18 to the appropriate portion of the user's body which is desired to be cleaned or bathed. End 72 may be provided with an appropriate spray nozzle (not shown) which is generally well known within the field of bidets, in order to achieve a particular spray pattern.

Nozzle apparatus 21 further comprises a support and attachment member 73 whereby nozzle 70 is attached to plate 19 and is able to rotate relative thereto. Mounting member 73 comprises an elongated member having a substantially rectangular cross-sectional shape with the thinnest dimension being transverse to the longitudinal axis of plate 19. The thinness of mounting member 73 physically minimizes the inventive apparatus 18 from interfering with the opening 23 of toilet bowl 11. A mounting flange 74 includes one or more openings 75 therethrough and within which may be inserted appropriate fasteners 76 in order to affix mounting member 73 to plate 19. An opening 77 through mounting member 73 and counterbored 78 at its upper end is provided to permit passage therethrough and retention thereof of nozzle tube 70. A bearing member 79, which may comprise a simple sleeve, may be press fitted within the lower end of opening 77. The internal diameter of bearing 79 is slightly greater than the outer diameter of the nozzle tube 70 and whereby substantially frictionless relative rotational motion of the nozzle tube 70 is allowed.

The upper or inlet port 71 of nozzle member 70 is provided with sleeve member 80 which may be fixedly attached to the nozzle 70 or made integral therewith. A lower cylindrical portion 81 of sleeve member 80 fits closely within counterbore portion 78 in mounting member 73 and also provides for relative rotational motion between the nozzle tube 70 and mounting member 73. The lower portion 81 of upper sleeve member 80 and the lower sleeve member 79 are appropriately axially spaced from each other such that smooth rotational movement of nozzle member 70 is provided.

Upper sleeve member 80 includes a flange 82 having a lower surface which is in contact with the upper surface of mounting member 73 and thereby limits the downward relative axial motion between nozzle 70 and mounting member 73. A cylindrical extension 83 protrudes from the upper surface of flange 82. Both flange 82 and the extending cylindrical portion 83 fit within a blind cylindrical opening 84 in the underside of plate 19. Hence, the upper surface of extending portion 83 in combination with the blind surface of opening 84 in plate 19 limits the relative upward axial motion of nozzle tube 70. Thus, nozzle tube 70 is free to rotate but is limited in its ability to move axially (either downward or upward).

The cylindrically protruding portion 83 of upper sleeve member 80 includes a cutout portion 85 (FIG. 5) which allows the flow of the fluid passing within the inventive apparatus 18 to enter within the inlet end 71 of nozzle tube 70. A small amount of flow clearance may be also provided between the upper end of cylindrical protrusion 83 and the lower surface of blind hole 84 in plate 19 in order to ensure that an adequate amount of fluid enters nozzle tube 70. Seal 86 between mounting member 73 and plate 19 prevents any flow leakage outside of nozzle tube 70.

In the inventive apparatus 18, flow communication between outlet port 27, which is located at combination control apparatus 20, and the inlet end 71 of the nozzle 70 is provided by flow channel or conduit 29. One embodiment of flow channel 29 is shown in FIGS. 3 through 5 and 8 of the drawings. There, it is seen that flow channel 29 is integral with plate 19 and comprises a double cutout, one of which is covered by a plate member. Cutout 87 is the deeper of the two cutouts, while the more shallow cutout 88 extends beyond the width of cutout 87. Elongated plate member 89 is sealingly fitted within cutout 88 by any well-known conventional means, such as gluing. Channel 29, then, comprises the flow area formed by cutout 87 and plate member 89. It is to be noted that both cutouts 87 and 88 extend to and intersect with blind hole 84 in plate 19 at one end and to counterbored opening 59 in plate 19 at the other end. In this manner, end 28 of channel 29 flow communicates with outlet port 27; and, end 90 of channel 29 flow communicates with the inlet end 71 of nozzle 70. Since operational valve stem 50 turns on or turns off the flow the fluid through combination apparatus 20, it also starts and stops the flow of the fluid through nozzle 70 because of the flow communication provided therebetween by flow channel 29.

A number of significant advantages are achieved by providing flow channel 29 integral with plate 19. For example: there are no flow tubes which pass under the toilet seat 13 or from outside the bowl 11 to the interior 23 thereof; the flat surface of rim 51 of bowl 11 is in contact only with the flat surface of plate 19; possible contamination of the inventive apparatus is minimized while cleaning of the same is facilitated.

As previously noted, rotation of nozzle 70 from a nonuse position to a use position is accomplished by rotation of valve stem 50 of control apparatus 20. The nonuse position of nozzle 70 is shown in phantom in FIG. 1. Such position generally locates nozzle tube 70 under the rim 51 and within the interior 23 of toilet bowl 11. And, since plate 19 is positioned whereby nozzle mounting member 73 is against the back vertical surface of rim 51, substantially all of the inventive apparatus 18 is physically precluded from interfering with the normal function of toilet 10 (due in part to the thinness of mounting member 73). Further, the portion of the inventive apparatus within the area of the interior 23 of the toilet bowl 11, fits under the seat portion 25 of toilet seat 13. Such placement further minimizes any interference of the inventive apparatus 18 with the function or operation of the water closet 10.

In order to rotate nozzle 70 from its nonuse position to its use position, approximately 45° of rotation of nozzle 70 is required. This rotation is accomplished by combination control apparatus 20 and lever member or bar 91, the latter of which is pivotally connected to nozzle cam 42 at one end and sleeve member 80 at its other end. Lever 91 comprises an elongated bar which fits within flow channel 29 and is pinned by pin 92 to flange 48 of nozzle cam 42 and by pin 93 to sleeve member 80 of nozzle apparatus 21. Both pin connections allow for relative rotation of the interconnecting parts. The cross-sectional shape of bar 91 is relatively small in such that it does not materially interfere with the amount of flow through channel 29. Furthermore, flow channel 29 can be sized as large as necessary to compensate for the presence of bar 91.

In accordance with the above description, it will be remembered that approximately 45° of counterclockwise rotation of valve stem 50 is required to move nozzle 70 from a nonuse to a use position; then, another 45° rotation, clockwise, turns the fluid flow on. Further clockwise rotation of valve stem 50 causes the fluid flow to be turned off and then because of the intersection of driver lug 62 and driven lug 64, simultaneous rotation of nozzle cam 42 occurs. This rotation translates into axial motion of bar 91 and then into rotational motion of upper sleeve member 80. Since sleeve member 80 is attached to nozzle 70, rotation of nozzle 70 to its nonuse position thereby is accomplished. Counterclockwise rotation of valve stem 50 then repositions nozzle cam 42 and valve stem 50 to its original position whereby the inventive apparatus 18 is ready for reuse at a later time. Cutouts 94 and 95 in spacer member 61 and cylindrical protrusion member 83, respectively, allow for movement of the ends of lever 95 without interference from these members. Valve stem 50 may be rotated by means of a knob which may be conventionally attached to valve stem 50.

While the invention has been described, disclosed, illustrated and shown in certain terms or certain embodiments or modifications which is has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. Hygiene apparatus adapted to be fitted to a toilet bowl for cleansing or bathing a user's posterior or genital areas, comprising: a base mounted onto said toilet bowl; nozzle means connected to said base for directing the flow of a fluid to said user's posterior or genital areas; combination control means for controlling the flow of said fluid through said nozzle means and for controlling arcuate movement of said nozzle means from a nonuse position to a use position; means connected to said combination control means and said nozzle means for moving said nozzle means in said arcuate manner; and conduit means connected to said combination control means and said nozzle means for providing flow communication of said fluid from said combination control means to said nozzle means, wherein said conduit means comprises an opening integral with said base and extends from an outlet port at said combination control means to an inlet port at said nozzle means, and said means for moving said nozzle means comprises an elongated bar pivotally attached at one end to a rotatable member of said control means and pivotally attached at its other end to a nozzle of said nozzle means whereby rotation of said rotatable member of said combination control means causes rotation of said nozzle means in said arcuate manner, and said elongated bar member fits within said conduit opening integral with said base.

2. The apparatus of claim 1, wherein said nozzle means comprises a substantially "U"-shaped nozzle tube with a first vertical portion thereof attached substantially perpendicular to a lower substantially horizontal surface of said base, the end of said first vertical portion fitting within an opening in said base and arranged for rotational movement therein, said opening and said end of said first portion being in flow communication with the combination control means whereby operation of the combination control means causes both initiation and cessation of the flow of said fluid into and through said nozzle means.

3. The apparatus of claim 2, wherein said nozzle tube further comprises a second horizontal portion and a third vertical portion, and wherein said nonuse position locates said second and third portions substantially parallel with the longitudinal axis of the base, and wherein said use position locates said second and third portions substantially perpendicular to the longitudinal axis of the base, whereby the nonuse position is under and against the back rim of a toilet bowl and the use position is in the center of the opening of a toilet bowl when said apparatus is adapted to a toilet bowl.

4. The apparatus of claim 3, wherein said nozzle means comprises a support member attached to the lower horizontal surface of said base having an opening therethrough and within which said first vertical portion of said nozzle is fitted and supported thereby, said first vertical portion being arranged for rotational movement within said opening in said support member.

5. The apparatus of claim 4, wherein said nozzle support member extending down from the bottom surface of said base comprises an elongated member with a thickness, in the vertical direction slightly larger than the outer diameter of said nozzle tube whereby said first vertical portion of said nozzle tube fits substantially flush against the inside upper vertical surface of a toilet bowl, at the back thereof, when said apparatus is adapted to a toilet bowl, and said support member extends therefrom by an amount only slightly more than the outer diameter of said nozzle.

6. Hygiene apparatus adapted to be fitted to a toilet bowl for cleansing or bathing a user's posterior or genital areas comprising:

nozzle means connected to said base for directing the flow of a fluid to the user's posterior or genital areas;

combination control means for controlling the flow of the fluid through aid nozzle means and for controlling arcuate movement of said nozzle means for a nonuse position to a use poistion, said combination control means comprising, a housing having an opening therethrough, said housing being attached to an underside surface of said base, a source of fluid being attached to a first and of said opening through said housing, a first rotatable elongated member being inserted in and extending out of the second end of said opening through said housing and further extending through and out from an opening in said base, said first rotatable elongated member being hollow and having an opening through the wall thereof, and a pair of oppositely disposed driver lugs attached to the iner surface thereof, a second rotatable member inserted within said first rotatable elongated member, a blind hole in said second rotatable member in flow communication with said first end of said opening through said housing, an opening through the wall of said second rotatable member located at the same axial location of the hole through the wall of the first rotatable member, and a driving-lug attached to the outer surface located at the same axial location of said driver lugs, and handle apparatus attached to the outwardly extending portion, a stationary cylindrical hollow member interposed between said first and second rotatable members, a hole through the wall thereof located at the same axial location of the holes through said first and second rotatable members, and handle apparatus attached to the outwardly extending portion of said second rotatable member, means connected to said combination control means and said nozzle means for moving said nozzle means in said arcuate manner; and, conduit means connected to said combination control means and said nozzle means for providing flow communication of said fluid from said combination control means to said nozzle means, whereby rotation of said second rotatable member sequentially causes engagement of said driver lug with a first of said driven lugs followed by rotation of said first rotatable member and then rotation of said nozzle means from the nonuse position to the use position; whereby reverse rotation of said second rotatable member sequentially causes flow of said fluid from said first end of the opening through the housing, through the combination control means, through the conduit means, and then through the nozzle means; and, whereby subsequent further rotation causes shutting off of the flow of the fluid and the repositioning of said nozzle means to its original nonuse position.

* * * * *